US008869336B2

(12) United States Patent
Meyer

(10) Patent No.: US 8,869,336 B2
(45) Date of Patent: Oct. 28, 2014

(54) OVERHEAD FORM TRAVELLER AND METHOD

(75) Inventor: Max Ernst Meyer, Woodlands East Ind. Est. (SG)

(73) Assignee: VSL International AG, Koniz (CH)

( * ) Notice: Subject to any disclaimer, the term of this patent is extended or adjusted under 35 U.S.C. 154(b) by 234 days.

(21) Appl. No.: 13/263,878

(22) PCT Filed: Apr. 15, 2009

(86) PCT No.: PCT/EP2009/054470

§ 371 (c)(1),
(2), (4) Date: Oct. 11, 2011

(87) PCT Pub. No.: WO2010/118773

PCT Pub. Date: Oct. 21, 2010

(65) Prior Publication Data

US 2012/0036811 A1 Feb. 16, 2012

(51) Int. Cl.
*E01D 21/10* (2006.01)
*E04G 21/14* (2006.01)

(52) U.S. Cl.
CPC ..... *E01D 21/10* (2013.01)
USPC ..... 14/77.1; 52/122.1; 414/10

(58) Field of Classification Search
USPC ..... 14/77.1, 77.3, 7, 74.5; 52/122.1, 126.1; 414/10, 11, 12; 212/175, 176, 179, 212/312, 317, 318, 324; 264/33; 425/63
See application file for complete search history.

(56) References Cited

U.S. PATENT DOCUMENTS 499,622 A * 6/1893 Weickel ..... 212/312
1,891,160 A * 12/1932 Jespersen ..... 264/32
3,027,633 A * 4/1962 Murphy ..... 14/4
3,448,511 A * 6/1969 Suter ..... 29/429
3,490,605 A * 1/1970 Koss ..... 212/175
3,511,057 A * 5/1970 Suter ..... 405/196
3,571,835 A * 3/1971 Buechler ..... 14/77.1
3,706,125 A * 12/1972 Hopkins ..... 29/428
3,845,515 A * 11/1974 Gelhard et al. ..... 14/77.3
3,937,165 A 2/1976 Thivans
3,985,480 A * 10/1976 Finsterwalder ..... 425/63
3,989,218 A * 11/1976 Muller ..... 249/20

(Continued)

FOREIGN PATENT DOCUMENTS

JP 09013328 A * 1/1997
JP 11092082 A 4/1999
JP 2001 226913 A 8/2001
JP 5484561 B2 * 5/2014

OTHER PUBLICATIONS

International Preliminary Report on Patentability for PCT/EP2009/054470 dated Oct. 18, 2011 (7 pages).*

(Continued)

*Primary Examiner* — Mark Wendell
*Assistant Examiner* — Rodney Mintz
(74) *Attorney, Agent, or Firm* — Pearne & Gordon LLP

(57) ABSTRACT

An apparatus and method are proposed for incremental casting of concrete cantilever bridge sections. The main trusses which form the load-bearing frames of the apparatus are angularly splayed so that they are positioned outwards of the main load bearing webs of the to-be-constructed section of the bridge, while still being supported on the webs of the already-constructed section of the bridge. In this way, the region above and below the construction space is kept free for improved access.

6 Claims, 6 Drawing Sheets

(56) References Cited

U.S. PATENT DOCUMENTS

| | | | | | |
|---|---|---|---|---|---|
| 4,087,220 | A * | 5/1978 | Koss | 425/63 |
| 4,103,861 | A * | 8/1978 | Buchler et al. | 249/20 |
| 4,231,977 | A * | 11/1980 | Schreck et al. | 264/33 |
| 4,260,126 | A * | 4/1981 | Schreck et al. | 249/20 |
| 4,282,978 | A * | 8/1981 | Zambon | 212/312 |
| 4,301,565 | A * | 11/1981 | Weinbaum | 14/77.1 |
| 4,497,153 | A * | 2/1985 | Muller | 14/77.1 |
| 4,799,279 | A * | 1/1989 | Muller | 14/77.1 |
| 5,016,407 | A * | 5/1991 | Becker et al. | 52/126.1 |
| 5,195,204 | A * | 3/1993 | Muller et al. | 14/4 |
| 5,511,266 | A * | 4/1996 | Dinis | 14/2.5 |
| 5,511,268 | A * | 4/1996 | Albus et al. | 14/77.1 |
| 5,653,351 | A * | 8/1997 | Grout et al. | 212/315 |
| 5,921,415 | A * | 7/1999 | Markelz | 212/294 |
| 5,947,308 | A * | 9/1999 | Markelz | 212/294 |
| 5,960,502 | A * | 10/1999 | Sherman et al. | 14/77.1 |
| 6,721,985 | B2 * | 4/2004 | McCrary | 14/77.1 |
| 7,210,183 | B2 * | 5/2007 | Kornatsky | 14/77.1 |
| 7,401,371 | B2 * | 7/2008 | Kornatsky | 14/77.1 |
| 7,461,427 | B2 * | 12/2008 | Ronald et al. | 14/77.1 |
| 7,478,450 | B2 * | 1/2009 | Fong | 14/77.1 |
| 7,520,014 | B2 * | 4/2009 | Homsi | 14/77.1 |
| 8,029,710 | B2 * | 10/2011 | Khoshnevis | 264/34 |
| 8,060,966 | B2 * | 11/2011 | Homsi | 14/77.1 |
| 8,166,596 | B2 * | 5/2012 | Kang et al. | 14/77.1 |
| 8,387,941 | B2 * | 3/2013 | Qin et al. | 249/1 |
| 8,555,442 | B2 * | 10/2013 | Liu et al. | 14/2.5 |
| 8,621,697 | B2 * | 1/2014 | Bruckner et al. | 14/77.1 |
| 8,671,490 | B1 * | 3/2014 | Carney et al. | 14/77.1 |
| 2004/0148717 | A1 * | 8/2004 | Kornatsky | 14/77.1 |
| 2008/0301889 | A1 * | 12/2008 | Kang et al. | 14/77.1 |
| 2009/0282625 | A1 * | 11/2009 | Homsi | 14/74.5 |
| 2011/0041267 | A1 * | 2/2011 | Sun | 14/77.1 |
| 2013/0055512 | A1 * | 3/2013 | Liu et al. | 14/77.1 |
| 2013/0081215 | A1 * | 4/2013 | Capolupo | 14/77.1 |
| 2014/0026335 | A1 * | 1/2014 | Smith | 14/77.3 |

OTHER PUBLICATIONS

International Search Report dated Jan. 29, 2010, for PCT/EP2009/054470.

* cited by examiner

OVERHEAD FORM TRAVELLER AND METHOD

The present application relates to a method and apparatus for constructing overhanging or cantilever structures. In particular, but not exclusively, the invention relates to the construction of concrete bridge elements cast in situ using the free cantilever method.

Bridge decks and other spanning, cantilevering or overhanging structures are often constructed by casting concrete in situ, using a temporary structure of shuttering or formwork to define a volume into which concrete is then poured. A structure of reinforcing steel is usually assembled in the volume, or placed into the volume, before the concrete is poured. Once the concrete is sufficiently cured so that the structure can support itself, the formwork is removed.

Instead of building a full set of formwork for casting an entire concrete structure in situ, which may require an extensive arrangement of supporting scaffolding as well as a firm, free area underneath the structure, form travelers are commonly used for cantilever structures. This is of particular advantage for the construction of span structures such as bridges, which by their nature are usually situated above water or terrain inaccessible for construction work. A conventional form traveler consists of a section of formwork which can be advanced in the direction of construction while being supported by the part of the structure which has already cured. A form traveler generally comprises a frame which provides support for the formwork and some means, such as rollers or rails, enabling it to travel forwards incrementally to each new section.

Conventional concrete bridge structures may comprise, for example, a number of piers supporting a bridge deck having an open cross-section with webs (vertical load-bearing members), for example in a "double T" or a "U" arrangement, or a closed cross-section such as a box section, having a deck slab, one or more webs and a bottom slab. In a "U" section structure, the deck slab is the bottom slab.

Conventional form traveler designs include the under-slung traveler and the overhead traveler. As its name suggests, an under-slung traveler is suspended underneath the bridge structure already erected, and extends beyond the end of the structure to support the formwork where the next section of the structure is to be cast. As construction progresses, the under-slung traveler is advanced underneath the developing structure.

An overhead traveler, on the other hand, is generally a frame mounted on top of the structure already erected, and it can be advanced forwards, on rails or rollers for example, to extend over the region where the next section is to be cast. In the case of an overhead traveler, the formwork hangs from the extended section of its frame.

In both cases, the weight of the construction elements, including formwork, traveler, reinforcement and uncured concrete, together with all the necessary access gantry structures, is supported on the part of the structure which has already been built. When each section of concrete has cured sufficiently to bear its own weight and the weight of the traveler, the traveler can be advanced to the next section.

It is essential that the traveler framework is highly stable and rigid, and that the formwork does not move significantly under the weight of the concrete as it is poured, or during the curing period. To this end, conventional overhead travelers comprise a multi-truss framework with a truss frame aligned with each web element of the deck structure. The frames are transversely braced, for example using cross trusses between the frames, to give the traveler framework transverse rigidity.

In the case of under-slung travelers, the framework is located either below the wings of the deck slab or below the bottom slab. The former arrangement has the disadvantage that the reactions into the bridge deck from the static weight of the traveler, the formwork and the concrete are not introduced directly into the webs (the webs being the parts of the deck structure with the greatest load-bearing capacity). The latter arrangement, on the other hand, can only be used on a structure where the traveler's path is unobstructed by objects beneath the structure. However, under-slung travelers do have the significant advantage of allowing virtually unrestricted access to the construction space from above. This means, for example, that pre-fabricated steel reinforcement can be lowered whole into the construction space. Reinforcement steelwork cages for the entire web, bottom slab and top slab of a bridge deck, for example, can be pre-fabricated and then lowered into place by a crane on the already-constructed bridge deck. In this way, on-site reinforcement assembly work can be saved, thereby significantly speeding up the on-site construction process.

Overhead travelers, by contrast, enable the introduction of the static weight reactions directly into the webs, and do not generally suffer from the obstruction disadvantage of under-slung travelers. However, conventional overhead travelers do have the disadvantage that their braced, multi-truss frame structure significantly impedes access to much of the construction space from above. Pre-fabrication of reinforcement cages for the main webs, the bottom slab and the main part of the top slab is therefore not feasible, or is only feasible for small sections, which significantly increases the amount of on-site assembly work required before each new section can be cast.

The object of the present invention, therefore, is to provide a method and apparatus for incremental construction of overhanging or self-supporting structures, which enables the static weight reactions to be introduced directly into the webs, which is not obstructed by piers or similar elements underneath the structure, and which permits substantially unrestricted access from above to the construction space within the formwork.

Throughout the following description and in the accompanying drawings, the same or similar components, will be referenced using the same reference numerals for the sake of clarity.

The accompanying drawings are included to provide a further understanding of the invention and are incorporated in and constitute a part of this invention. The drawings serve to illustrate embodiments of the present invention and, taken together with the description, serve to explain the principles of the invention. However they are not intended to limit the scope of the invention, which is defined by the accompanying claims.

Figure 1:
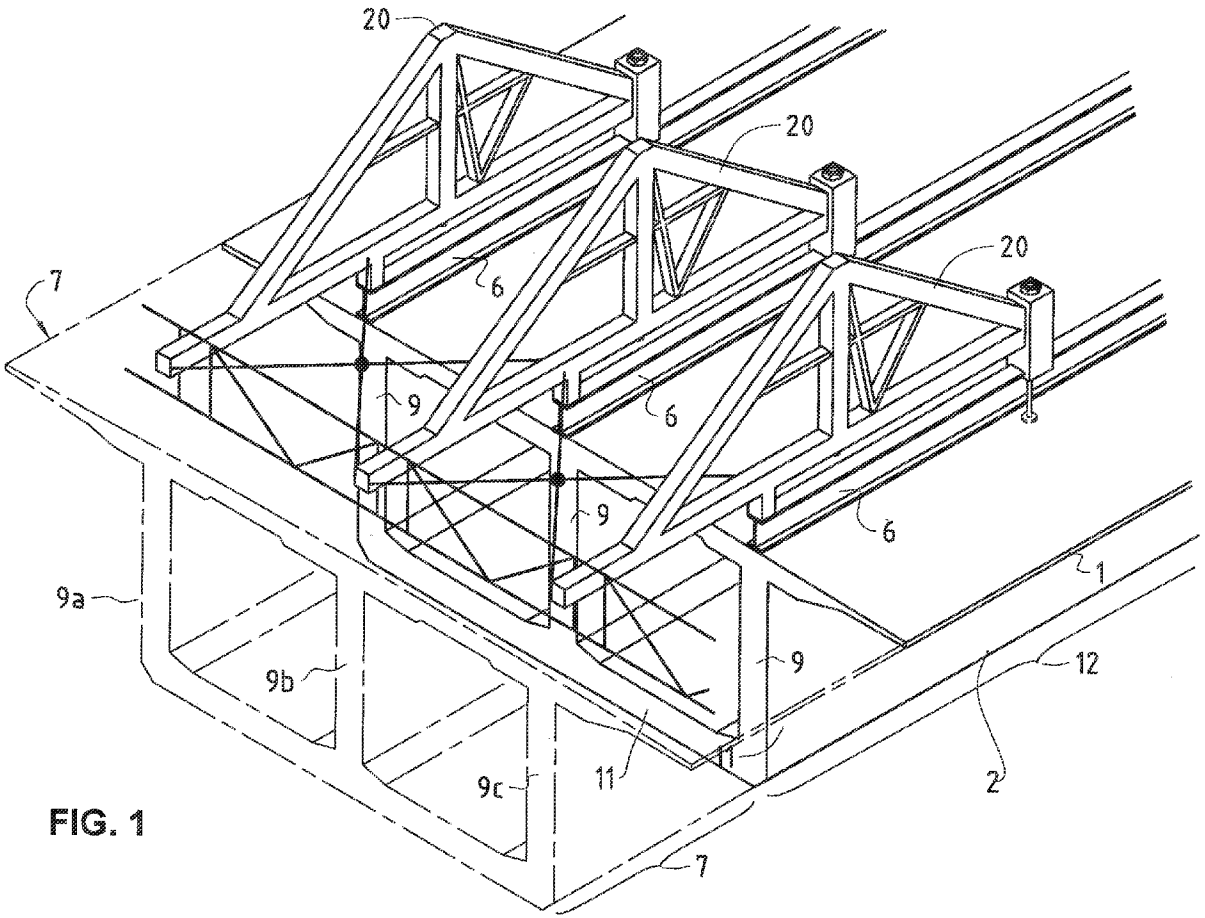
FIG. 1 PRIOR ART
FIG. 1 illustrates a prior art overhead traveler.
Figure 2:
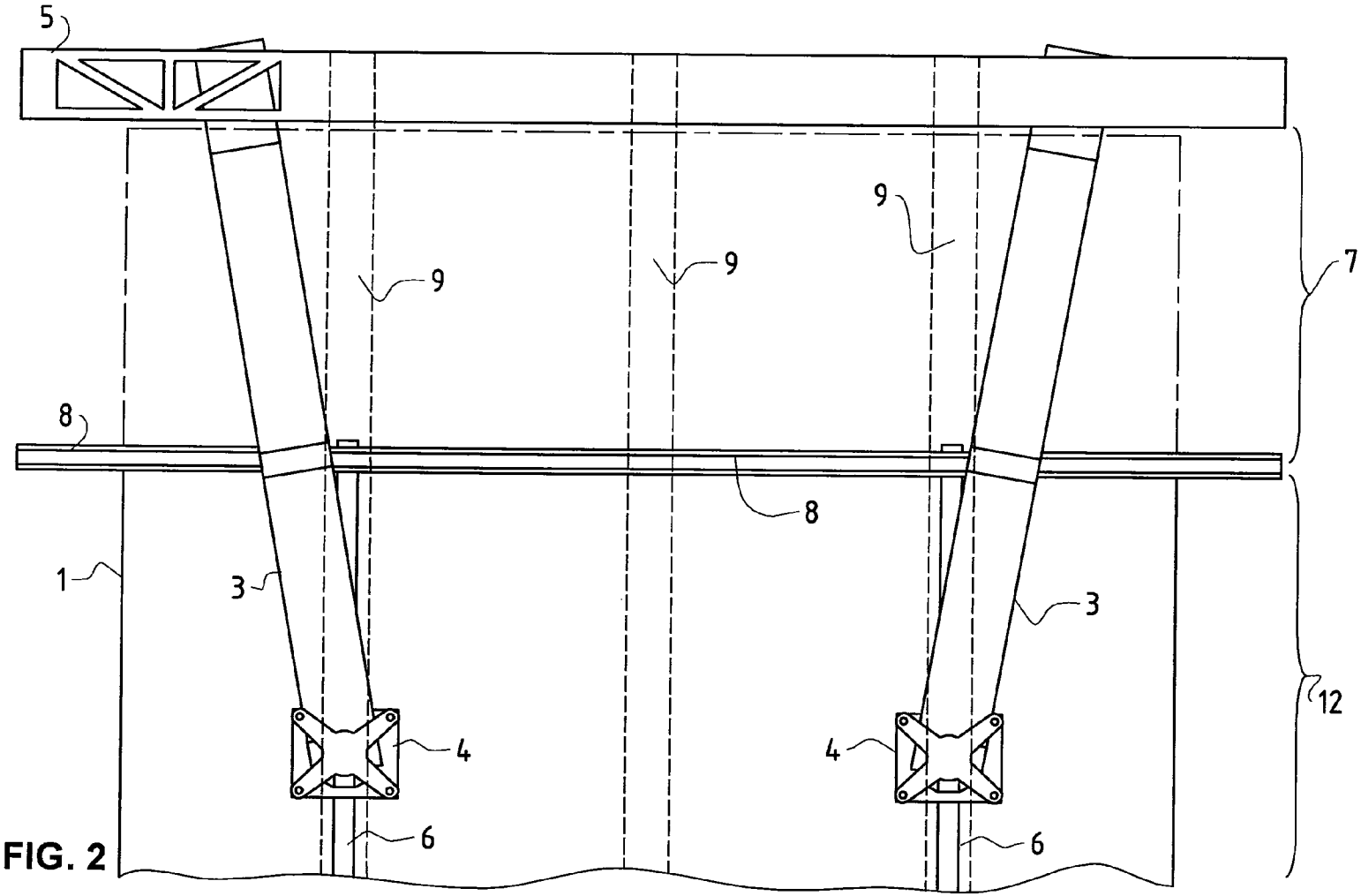
FIG. 2 illustrates a plan view of the overhead traveler of the present invention.
Figure 3:
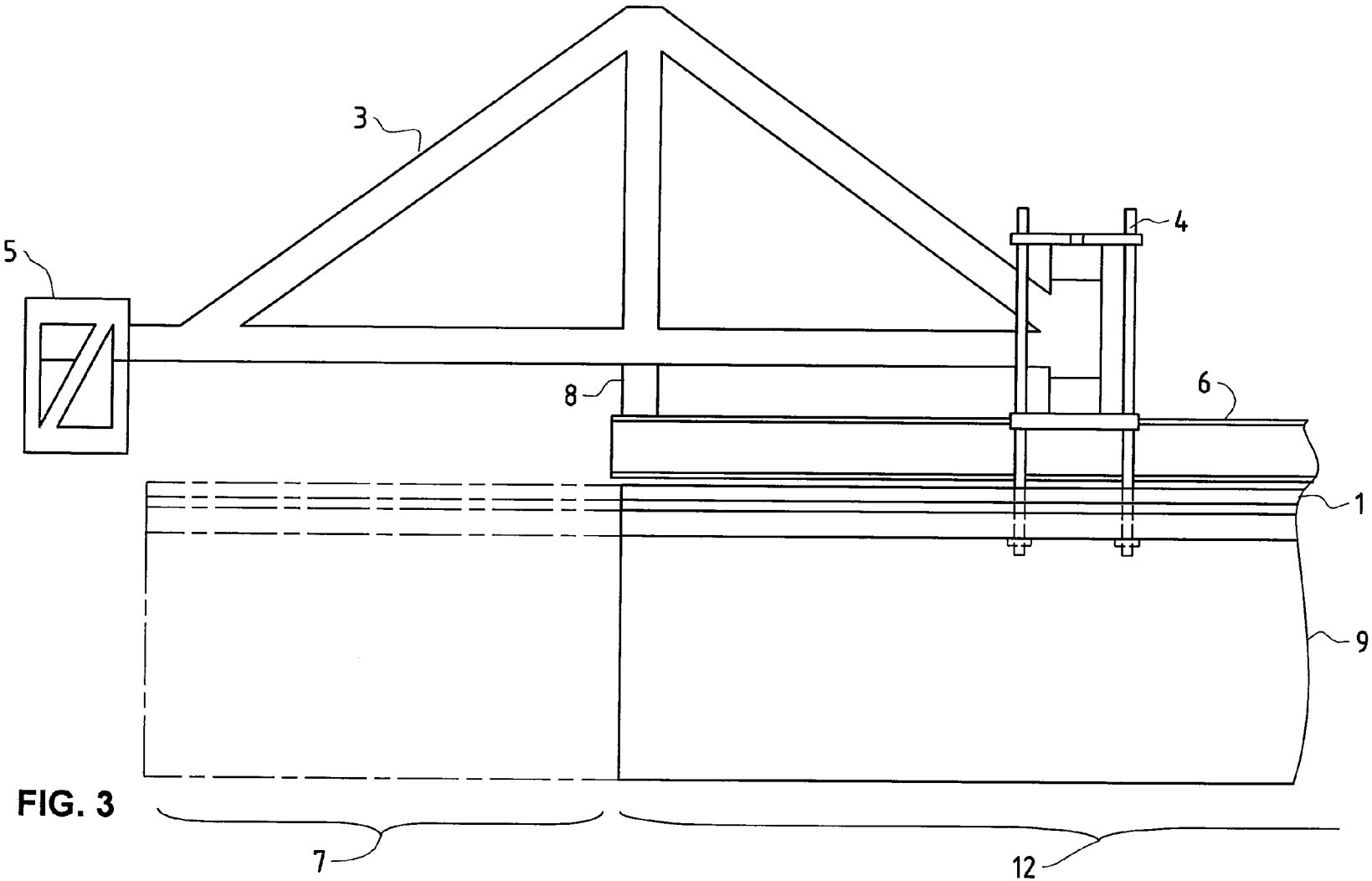
FIG. 3 illustrates a side elevation of the overhead traveler of the present invention.
Figure 4:
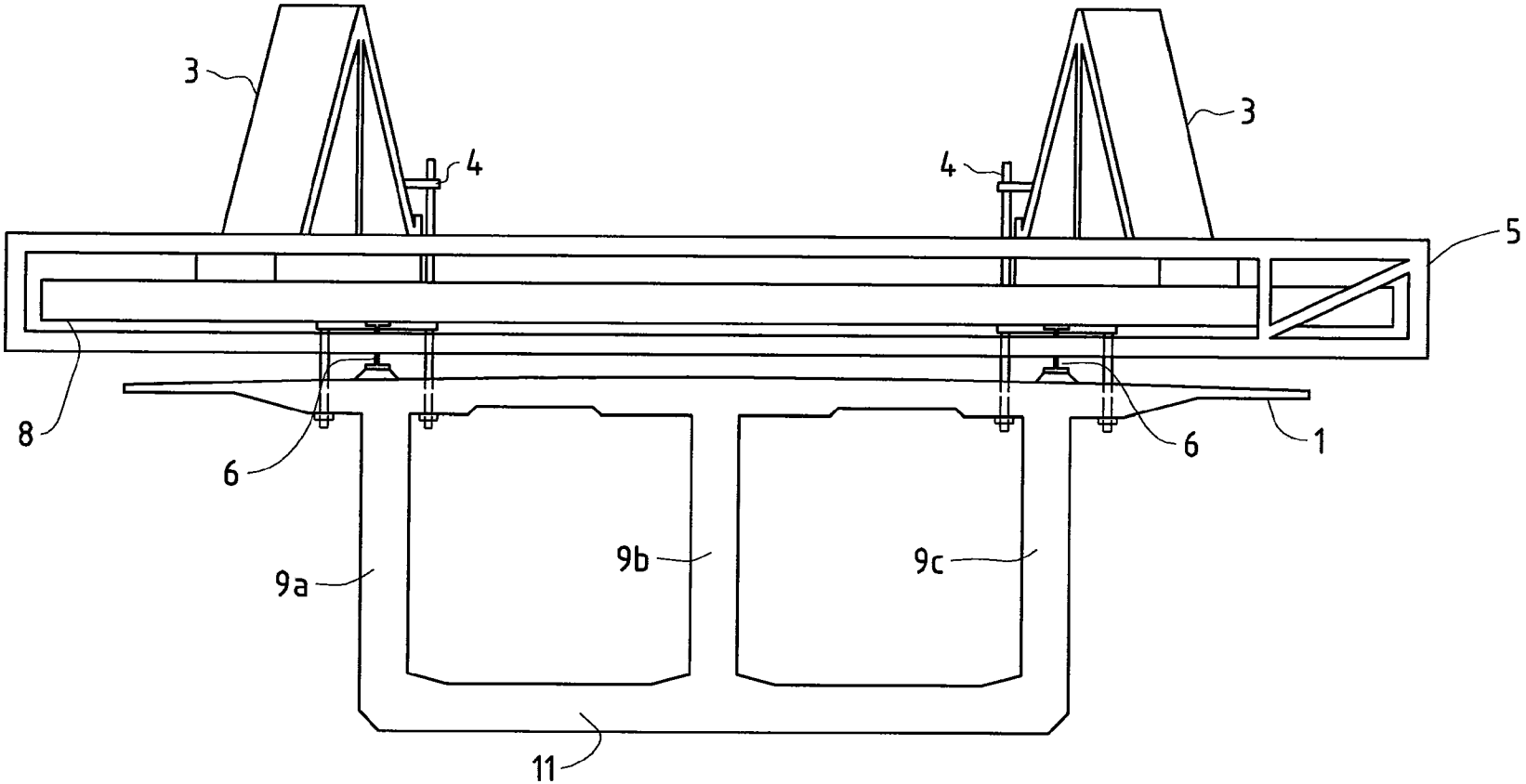
FIG. 4 illustrates a frontal elevation of the overhead traveller of the present invention.
Figure 5:
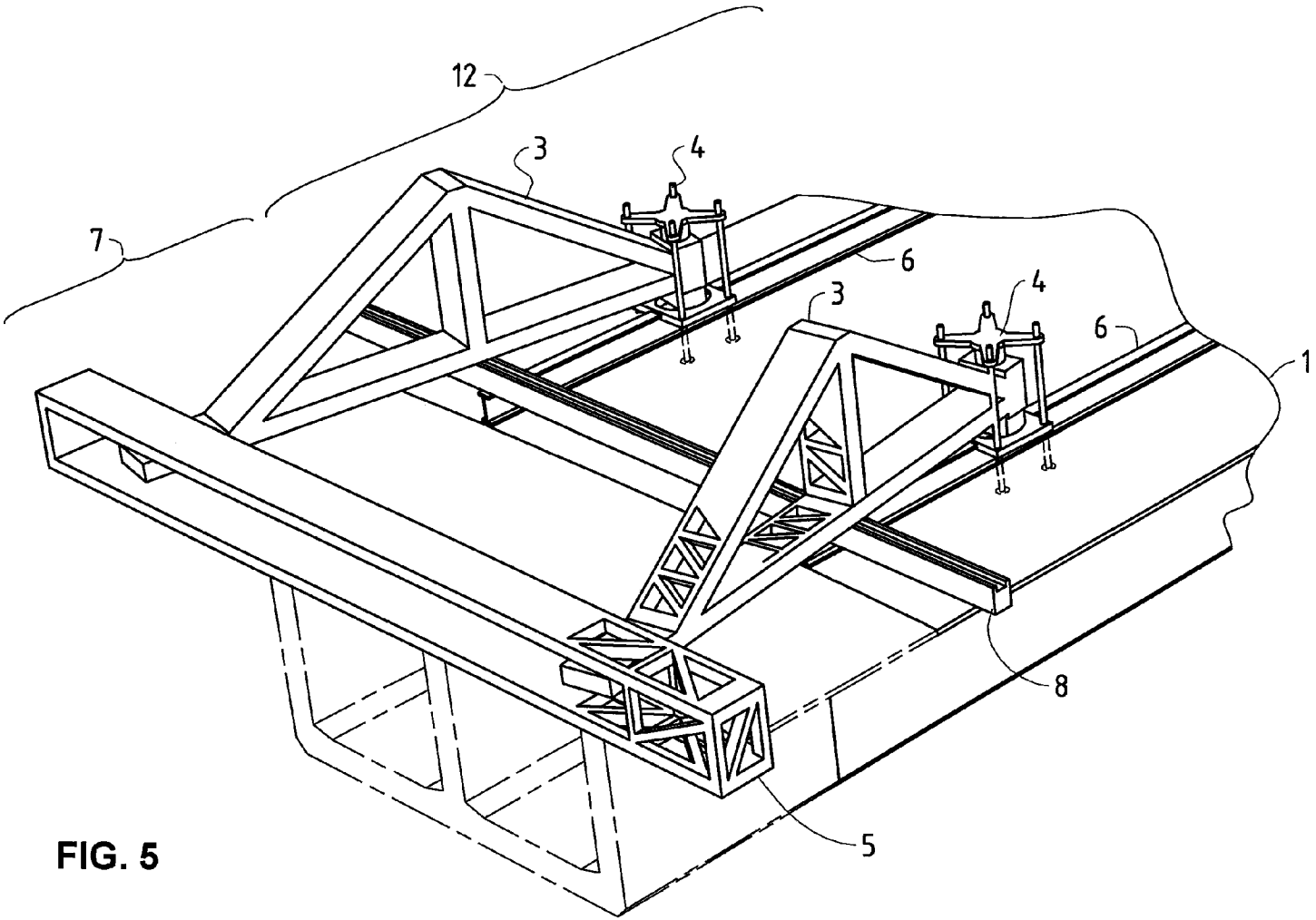
FIGS. 5 and 6 illustrate perspectives view of the overhead traveler of the present invention.
Figure 6:
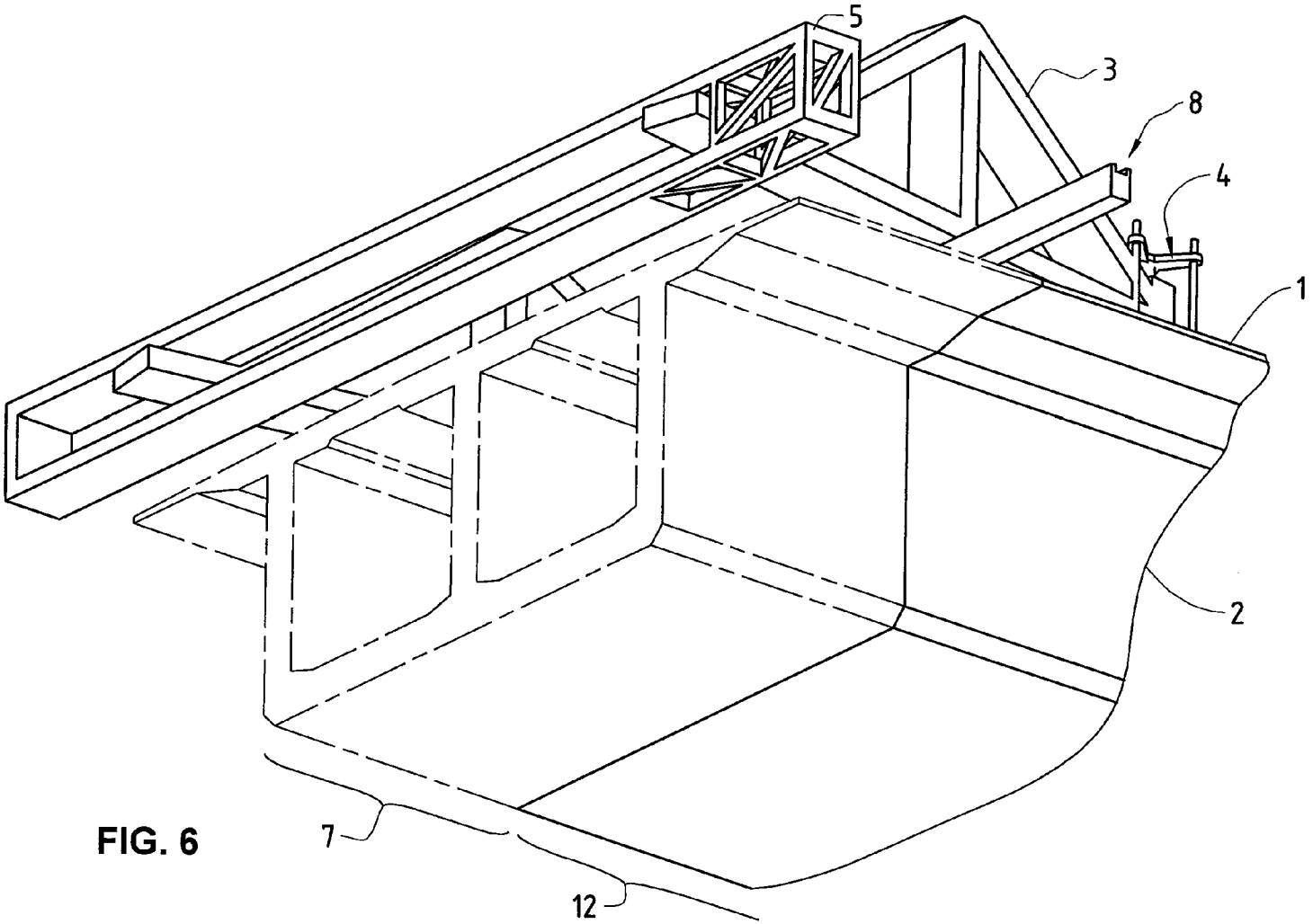

A prior art overhead form traveler is depicted in schematic form in FIG. 1. In the highly simplified representation of FIG. 1, a bridge section is shown with three webs (9), a top slab (1) and a bottom slab (11). Directly above each web (9) is fixed a rail (6), and these rails (6) allow the traveler structure (20) to be advanced for each new section (7). The rails (6) are also moved forward in the direction of construction for each new section (7). The conventional traveler also comprises a structure of frames and diagonal bracing elements to give the traveler's frame structure (20) sufficient strength to support the load of the new section while the concrete is being poured and cured. The frames introduce loading during construction of a new section directly into, or near to, the webs of the previously completed section. Note that, for the sake of clarity, the formwork is not depicted in the drawings. However, it will be understood that, although not shown, these elements are suspended from the overhead traveler and advanced with the traveler so that they are in place for the construction of each new section. In this manner, the weight of each new section is borne by the existing structure while the new section is under construction.

Using the conventional overhead traveler of the prior art, the reinforcement required for each new section must be assembled in situ, since the structure of the traveler does not allow complete prefabricated reinforcement cages to be lowered down into the construction space. Such prefabricated reinforcement can also not be raised from below the bridge once the traveler has been advanced, because the traveler and the formwork obstruct access from below to the region where the reinforcement is required.

An apparatus and method are proposed for incremental casting of concrete cantilever bridge sections (7, 12). The main trusses which form the load-bearing frames (3) of the apparatus are angularly splayed so that they are positioned outwards of the main load bearing webs of the to-be-constructed section (7) of the bridge, while still being supported on the webs of the already-constructed section (12) of the bridge. In this way, the region above and below the construction space is kept free for improved access.

FIGS. 2 to 6 show a simplified example, in schematic form and from various views, to illustrate the principle of the invention. FIGS. 2 to 6 show a similar bridge structure to the structure in FIG. 1, comprising three webs (9), a bottom slab (11), and a top slab (1). However, the traveler shown in FIGS. 2 to 6 has two load frames (3), mounted on rails (6)—one over each outer web. Furthermore, the load frames (3) according to the invention are arranged so that they can be rotated outwards to allow improved access to the construction space (7) from above. In order to be able to rotate the load frames, the deck-mounting point (4) of each load frame may be designed to allow a rotation of the frame about an axis substantially vertical (ie perpendicular to the upper plane of the structure) while still securing the load frame to the load-bearing outer webs (9*a*, 9*c*) as shown. The deck-mounting point (4) is also referred to as an orientation adjustment device for orienting each longitudinal load frame element (3) to a splayed orientation such that the distal portion of said each longitudinal load frame element (3) is positioned to support a weight of the next construction section but not directly over the one or more longitudinal load-bearing web elements (9) of the next construction section. The mid-portion of each load frame is mounted on a transverse load beam (8), known as the lower crossbeam, which serves as a support for the mid-portions of each load frame. Respective reactions from the load frames are transferred to the rails (6) during launching of the traveler, then directly to the two outer webs (9*a*, 9*c*) during the construction of the new segment. The transverse load beam (8) is also referred to as an adjustable support for adjustably supporting the mid-portion of each longitudinal load frame element (3) in the splayed orientation. The transverse load beam (8) transfers load forces occasioned during the process of constructing the next construction section to the one or more longitudinal load-bearing web elements (9) of the completed part of the partially completed cantilever structure. In addition, the load frames are constructed such that they are capable of supporting the required loads without the need for bracing structures between them.

Note that, while this description has concentrated on the example in which the cantilever structure has two or more longitudinal webs, it is also possible to use the overhead traveler and method of the invention for structures which have only one longitudinal web. In such a case, the proximal ends of both load frames are secured to the same web, and the load frames are splayed outward so as to afford access to the construction volume of the next section, in the same way as for structures with more than on longitudinal web.

Whereas previous travelers comprised several relatively lightweight load frames braced together in a single structure, the load frames according to the present invention are each individually constructed to support the vertical load of the formwork and the concrete when it is poured, but also to resist any rotational or torsional forces on it due, for example, to the wind, or to non-vertical loads occasioned during the construction process. This strength is achieved, for example, by constructing each of the individual load frames as a three-dimensionally triangulated structure, as partially indicated in FIG. 5. Note that this structure is only indicated in part of the drawn element in order to simplify the drawing. Furthermore, while the other drawings do not show the detailed structure of the load-frames, it will be understood that such a structure (for example a triangulated structure of trusses and/or braces) capable of bearing the vertical load forces, as well as any potential rotational or torsional forces, is implied.

When they are installed in their operational position, the load frames extend out over the next section to be constructed, but rotated at such an angle to the longitudinal axis or the structure that substantially no part of the frame is directly above the main load-bearing region (2) of the next construction section. The installion of each load frame at a splayed angle to the longitudinal axis of the bridge deck structure, and the absence of traveler components over the main load-bearing parts of the next section of the structure, mean that the reinforcement elements for these load bearing parts (webs, top slap and bottom slab) and also for the central part of the deck slab (1), or bridge deck, can be pre-fabricated and positioned (by lowering from the deck by crane, for example) in the construction volume, thereby saving significant time assembling the reinforcement in situ before pouring concrete.

The angular position of the load frames would normally be set once for each specific structure being built. For example, for the bridge depicted in FIGS. 2 to 6, if the cross-section of the bridge does not vary significantly over the sections being cast, then the load frames can be rotated to their correct positions and then secured in place on the rails (6) and on the lower crossbeam (8). The transverse load beam (8) is secured to the completed part of the partially completed cantilever structure at mounting points supported by the one or more longitudinal load-bearing web elements (9) of the completed part. Then as each new construction section is prepared, the traveler is moved forwards, with its load frames in the splayed-out orientation, to its position above the next section. However, it is also possible to use the same arrangement in the construction of a structure whose width varies along its length, and adapt the angular positioning of the load frames during the construction in addition to the initial positioning.

The invention claimed is:

1. Method of constructing a next construction section of a partially completed elongated cantilever structure, the elongated cantilever structure comprising a main longitudinal load-bearing region, said main load-bearing region comprising one or more longitudinal load-bearing web elements, the method comprising the steps of using an overhead form traveler comprising at least one pair of longitudinal load frame elements for supporting a weight of said next construction section, each of said longitudinal load frame elements comprising a distal portion for extending over said next construction section, a proximal portion for securing to a completed part of said partially completed cantilever structure at a point supported by one of said one or more longitudinal load-bearing web elements, and a mid-portion, between said proximal and distal portions, securing the proximal portion of each of said at least one pair of longitudinal load frame elements to the completed part of said partially completed cantilever structure at the point supported by one of said one or more longitudinal load-bearing web elements; and setting a splayed angular orientation of the at least one pair of longitudinal load frame elements, wherein in the splayed orientation the distal portion of each one of the at least one pair of longitudinal load frame elements is positioned to support the weight of the next construction section outwards of, but not directly over said one or more longitudinal load-bearing web elements of said main load-bearing region of said next construction section, and adjustably supporting the mid-portion of each said longitudinal load frame element in said splayed orientation using an adjustable support, wherein said adjustable support comprises a transverse load beam, including transferring load forces occasioned during a process of constructing said next construction section via said transverse load beam, to said one or more longitudinal load-bearing web elements of the completed part of said partially completed cantilever structure.

2. Method according to claim 1, further comprising, for each next construction section of the cantilever structure, the step of advancing said at least one pair of longitudinal load frame elements such that the distal ends of said longitudinal load frame elements project over a region where each said next construction section is to be constructed.

3. Overhead form traveller apparatus for supporting a next construction section of a partially completed, elongated cantilever structure, the elongated cantilever structure comprising a main longitudinal load-bearing region, said main load-bearing region comprising one or more longitudinal load-bearing web elements, the apparatus comprising at least one pair of longitudinal load frame elements for supporting a weight of said next construction section, each of said longitudinal load frame elements comprising a distal portion for extending over said next construction section, a proximal portion for securing to a completed part of said partially completed cantilever structure at a point supported by one of said one or more longitudinal load-bearing web elements, and a mid-portion, between said proximal and distal portions, an orientation adjustment device orienting the at least one pair of longitudinal load frame elements into a splayed orientation, wherein in the splayed orientation the distal portion of each one of the at least one pair of longitudinal load frame elements is positioned to support the weight of said next construction section outwards of, but not directly over, said one or more longitudinal load-bearing web elements of said next construction section, and an adjustable support for adjustably supporting the mid-portion of each said longitudinal load frame element in said splayed orientation, wherein said adjustable support comprises a transverse load beam for transferring load forces occasioned during a process of constructing said next construction section to said one or more longitudinal load-bearing web elements of the completed part of said partially completed cantilever structure.

4. Overhead form traveller apparatus according to claim 1, wherein said transverse load beam is secured to the completed part of said partially completed cantilever structure at mounting points supported by the one or more longitudinal load-bearing web elements of said completed part.

5. Overhead form traveller apparatus according to claim 1, in which said orientation adjustment device allows said each longitudinal load frame element to rotate about a substantially vertical axis.

6. Overhead form traveller apparatus according to claim 1, in which each of said longitudinal load frame elements is constructed so as to be individually capable of resisting rotational or torsional forces occasioned during the construction of the elongated cantilever structure without being braced to the other, or to one of the other, load frame elements.

* * * * *